US005112245A

United States Patent [19]

Shimirak et al.

[11] Patent Number: 5,112,245

[45] Date of Patent: May 12, 1992

[54] TELECOMMUNICATIONS TERMINAL BLOCK AND TERMINAL

[75] Inventors: Gerald L. Shimirak, Danville; Darcey L. Messner, Sunnyvale, both of Calif.

[73] Assignee: Raychem Corporation, Menlo Park, Calif.

[21] Appl. No.: 767,553

[22] Filed: Sep. 27, 1991

Related U.S. Application Data

[63] Continuation of Ser. No. 701,436, May 15, 1991, abandoned.

[51] Int. Cl.[5] ..... H01R 4/24

[52] U.S. Cl. ..... 439/412

[58] Field of Search ..... 439/389–425

[56] References Cited

U.S. PATENT DOCUMENTS

| | | | |
|---|---|---|---|
| 2,989,720 | 6/1961 | Rivkin | 339/99 |
| 3,094,366 | 6/1963 | Harmon, Jr. | 339/97 |
| 3,380,014 | 4/1968 | Schenker et al. | 339/97 |
| 3,391,379 | 7/1968 | Smotheman | 339/99 |
| 3,510,829 | 5/1970 | Keller | 339/177 |
| 3,688,246 | 8/1972 | Toedtman et al. | 339/95 |
| 3,816,818 | 6/1974 | Meier | 339/99 |
| 4,002,952 | 1/1977 | Menninga | 317/66 |
| 4,321,649 | 3/1982 | Gilberts | 361/119 |
| 4,641,218 | 2/1987 | Scalera | 361/119 |
| 4,971,573 | 11/1990 | Pinyan | 439/412 |

FOREIGN PATENT DOCUMENTS 2176062 12/1986 United Kingdom .

*Primary Examiner*—Joseph H. McGlynn

*Attorney, Agent, or Firm*—Herbert G. Burkard; William D. Zahrt, II; A. Stephen Zavell

[57] ABSTRACT

A telecommunications terminal (10) includes a series of teeth (14) opposite a juxtaposable surface (25). The region between the teeth (14) and surface (25) has a progressive taper such that a wire (22) captured therebetween is progressively engaged thereby.

69 Claims, 14 Drawing Sheets

FIG. 1
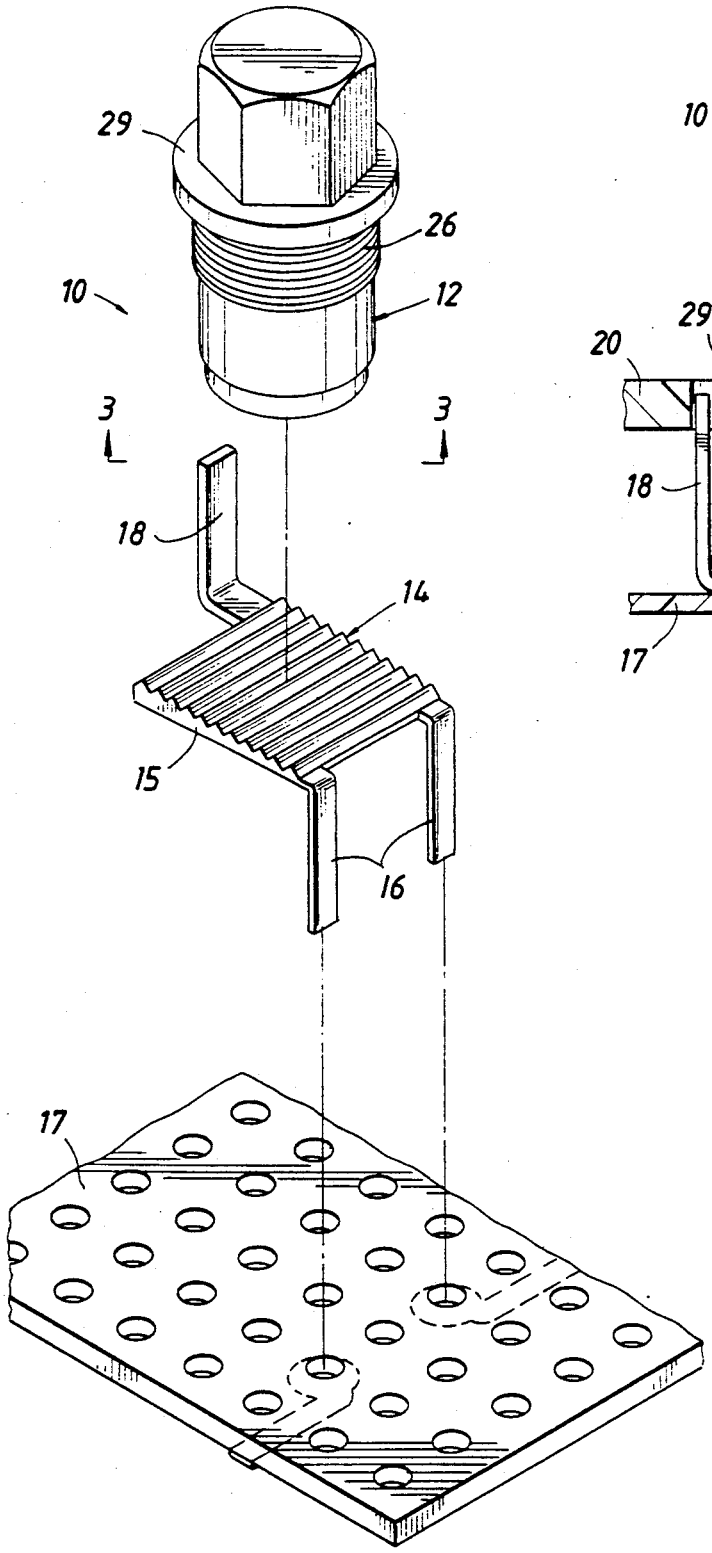
FIG. 2
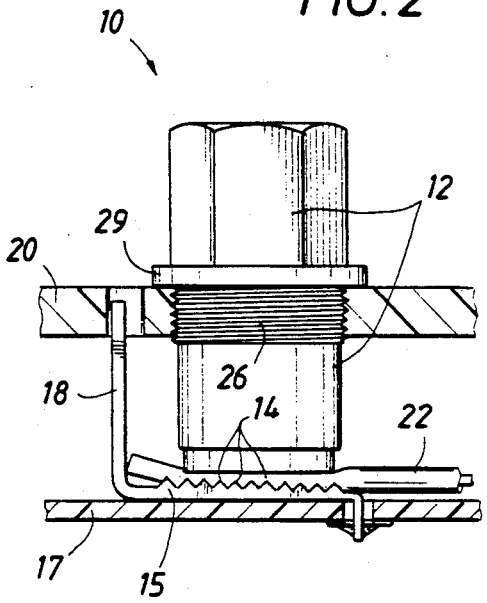
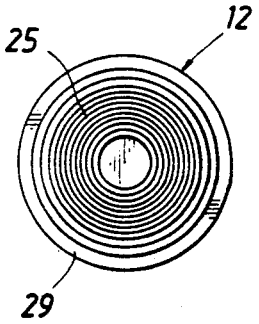
FIG. 3

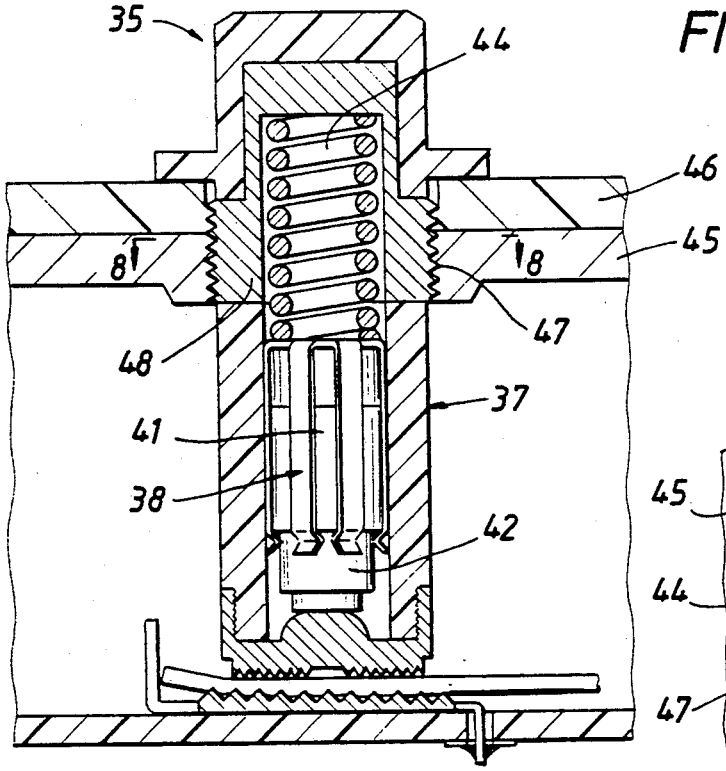
FIG. 7
FIG. 8
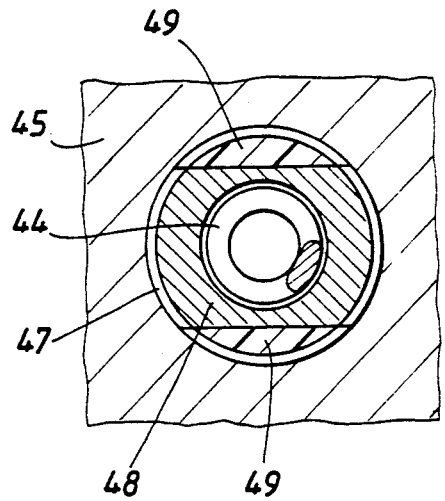
FIG. 9
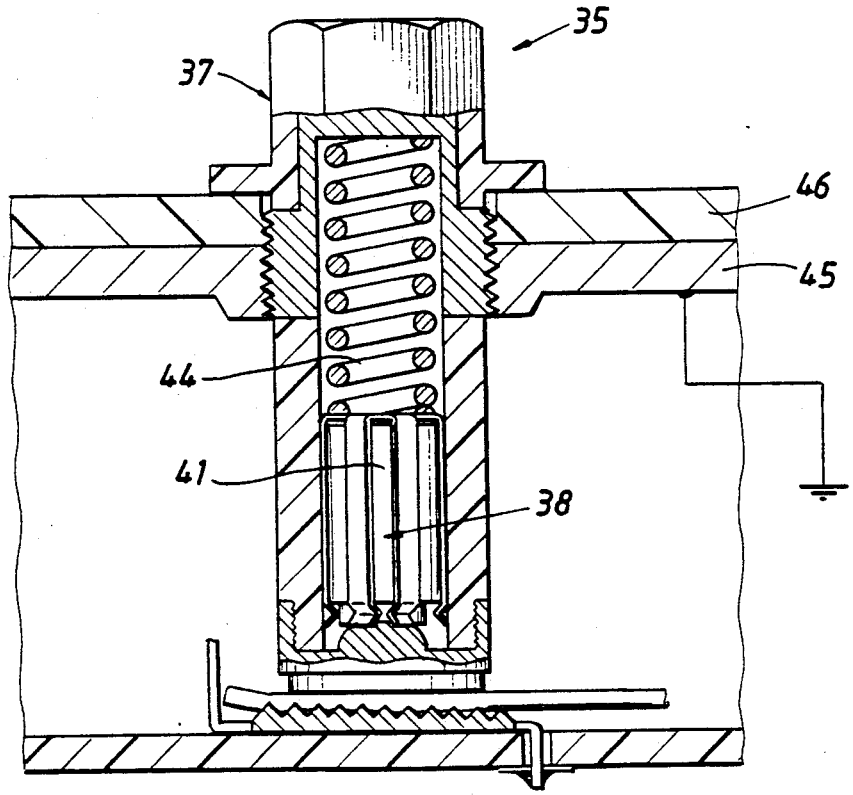

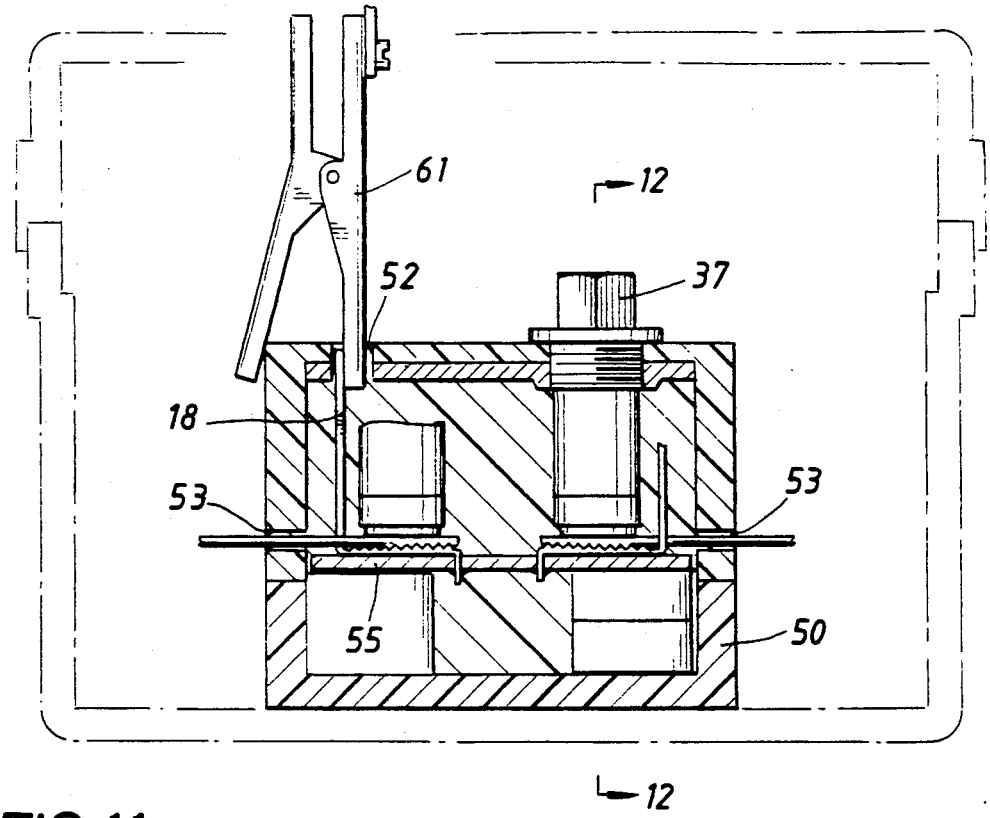
FIG. 11
FIG. 12
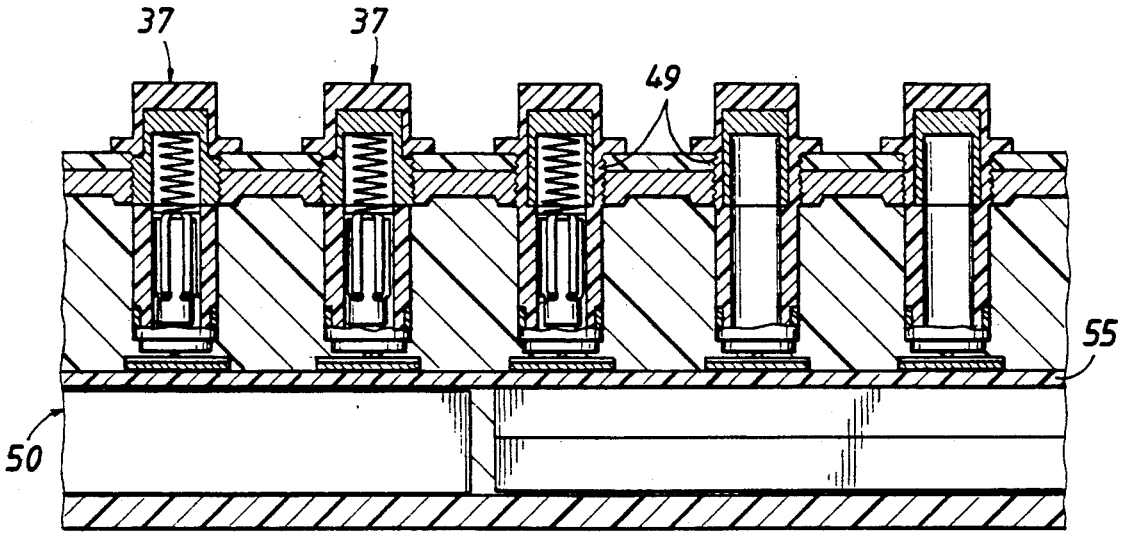

FIG. 17
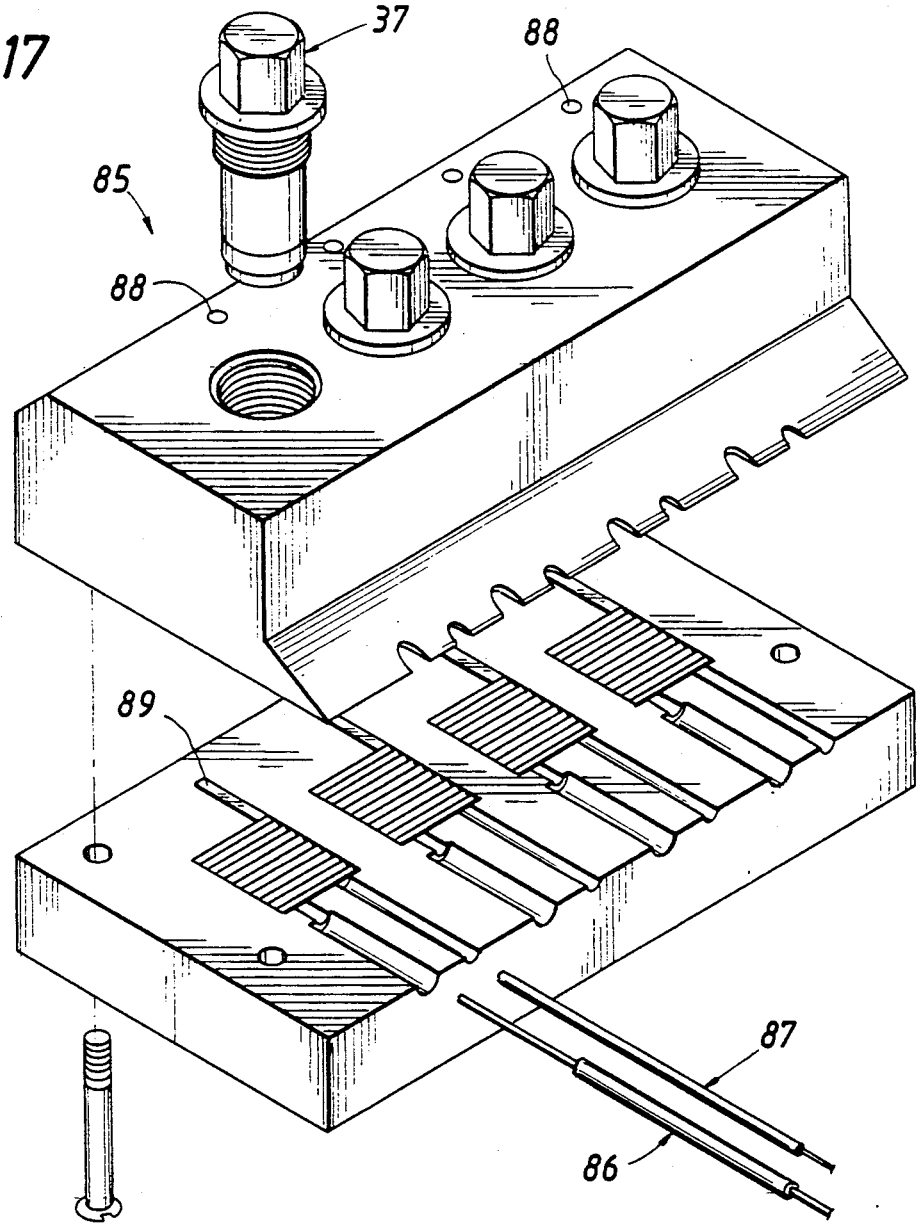
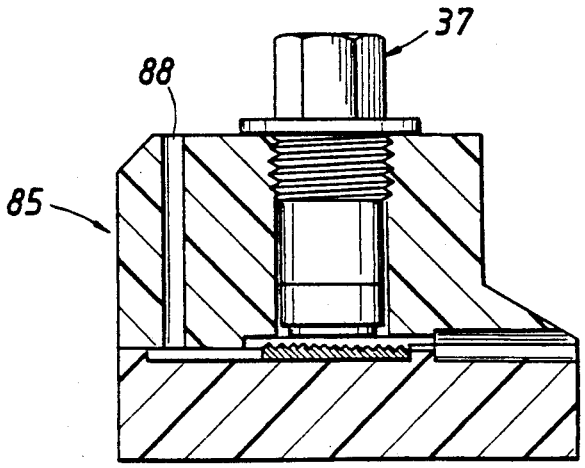
FIG. 18

FIG. 19
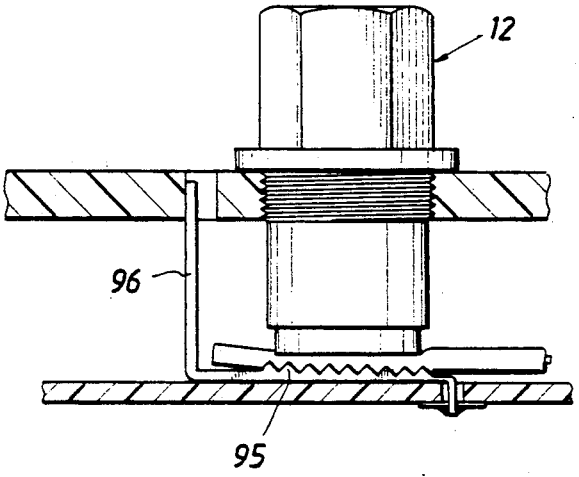
FIG. 20
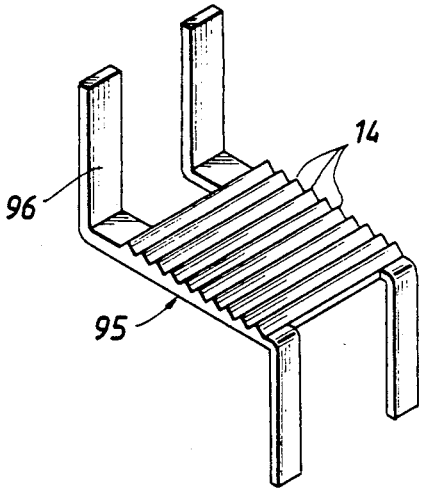
FIG. 21
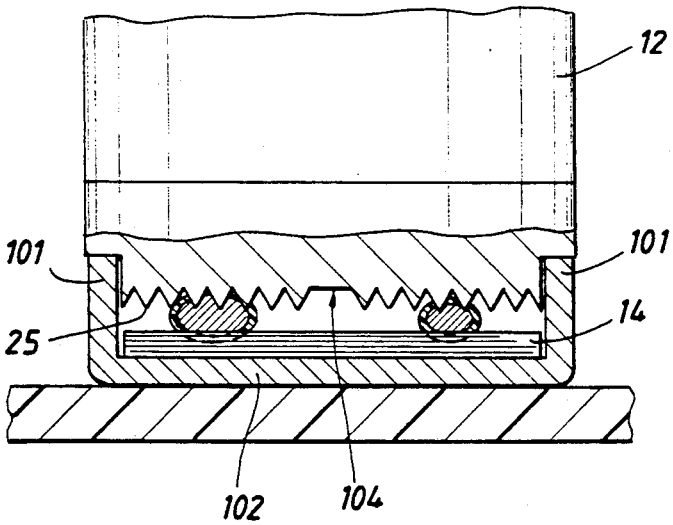
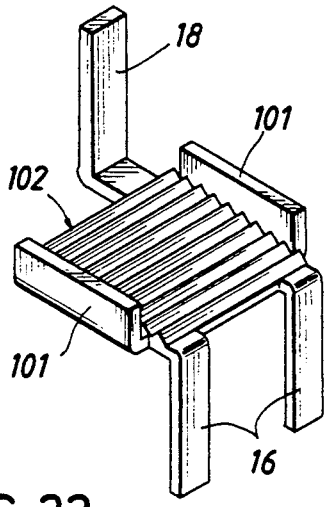
FIG. 22

FIG. 27
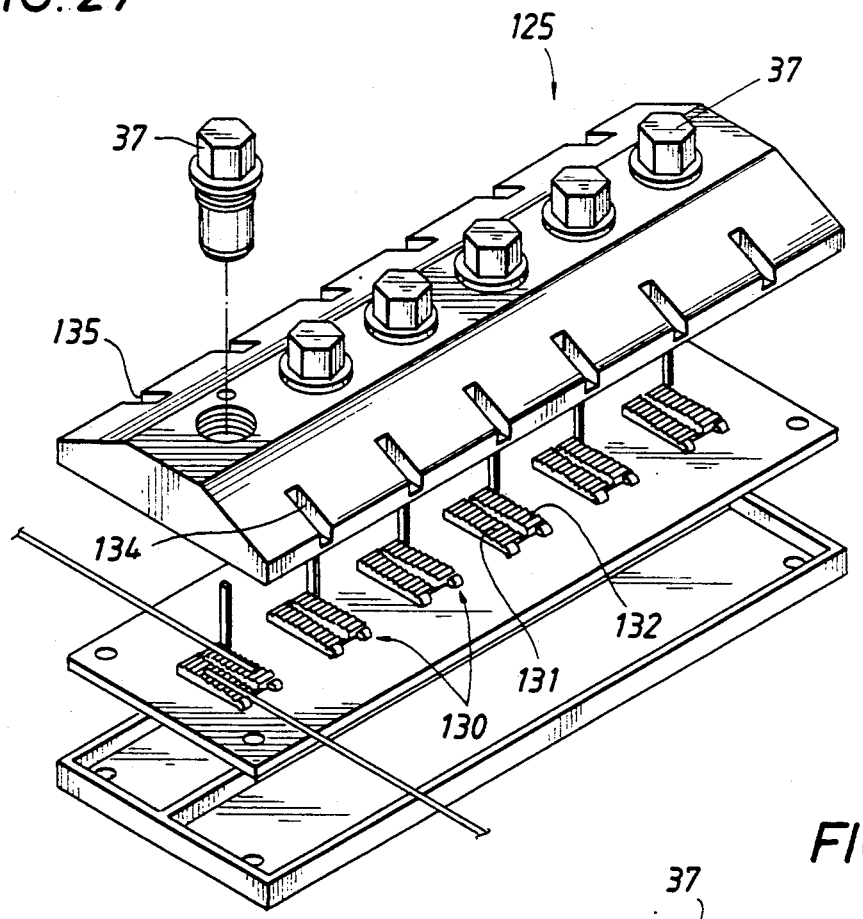
FIG. 28
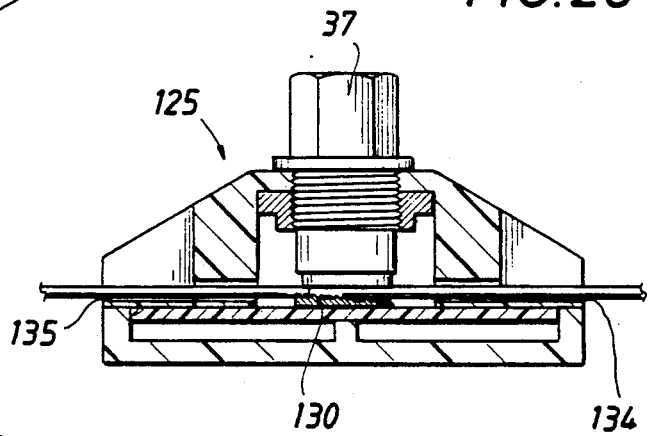
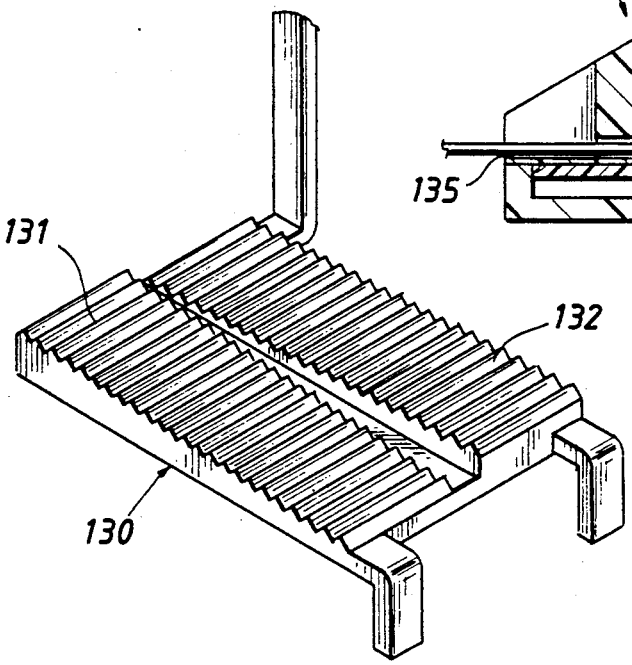
FIG. 29

FIG. 31
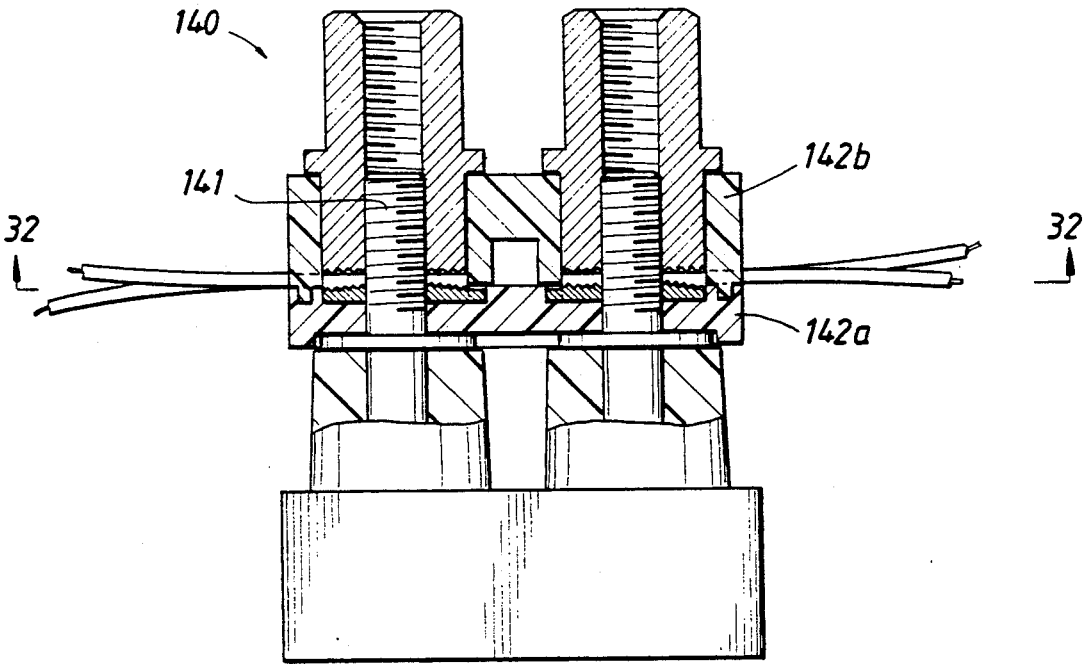
FIG. 32
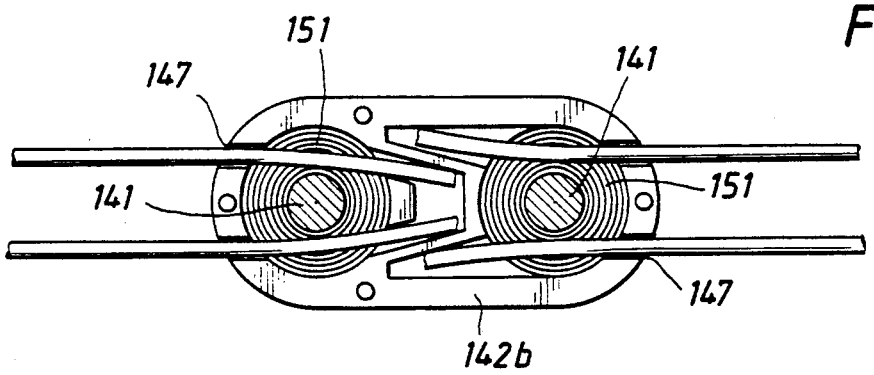
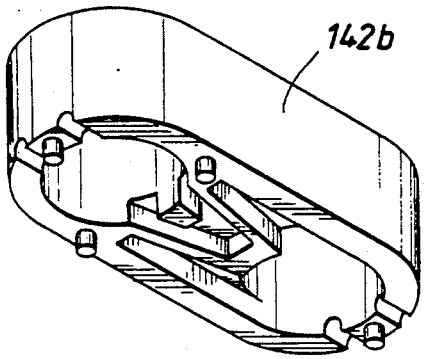
FIG. 33

TELECOMMUNICATIONS TERMINAL BLOCK AND TERMINAL

This application is a continuation of application No. 07/701,436, filed May 15, 1991, now abandoned.

BACKGROUND OF THE INVENTION

The present invention relates to telecommunications terminals and terminal blocks, and more particularly to improved insulation-displacing terminals capable of automatically penetrating through insulation to connect to wires of widely varying gauges, and of making such connections to multiple wires in a single terminal connection. The invention further relates to such improved terminals and terminal blocks in which protective circuitry may be directly incorporated as an integral, incremental, and cost-effective part of the connection itself.

Terminal design for the telecommunications industry is a subtle and challenging art which continues to receive a great deal of attention. Thousands upon thousands of connections are made and changed every day, some not to be touched again for decades. It is therefore important not only to minimize labor, manufacturing, and installation costs, but also to provide terminals which have the greatest electrical and physical integrity for the widest range of applications and environments. The less wire preparation which the installer must do, the better. The fewer terminal designs and sizes, the better. However, since wire sizes vary from 18½ gauge copper coated steel (F-drop) to 26 gauge single strand copper, with significant differences in insulation thicknesses and characteristics, this challenge has not been easy to fulfill. For example, insulation displacing connectors (IDC's) are commonly incorporated into terminal designs to reduce installation labor by eliminating the need for the installer to strip the wire. However, the telecommunications industry uses such a broad range of gauges and insulation thicknesses that it tends to limit the range in which IDC's can be used successfully. Also, IDC's can usually accept only one wire connection at a time. Further, wires which must be stress-relieved typically require separate provisions for this purpose apart from the IDC. Likewise, when current-/voltage protection is required (as per industry standards), additional terminal complication is introduced beyond the IDC itself.

A need therefore remains for improved methods and apparatus for connecting insulated conductors to terminal blocks, and in particular for such methods and apparatus which can effectively make such connections for a very large range of wire gauges, without the need to remove the wire's insulation in advance, which can do so simultaneously for several conductors of different gauges, which can provide stress relief for each such wire, which can provide circuit protection as needed, which can be reused repeatedly, and which can standardize production and utilization configurations to minimize costs and maximize versatility. The invention should be durable, reliable, economical to manufacture, and thus readily suited for utilization in the widest range of telecommunication applications.

SUMMARY OF THE INVENTION

Briefly, the present invention meets the above needs and purposes with a new and improved telecommunications terminal block, terminal, and methods therefor in which a single, uncomplicated terminal configuration is able to accommodate a full range of wire and insulation sizes, accomplish an IDC connection, and provide full stress-relief and strain support for the wires. Furthermore, a plurality of wires of the same or different gauges and insulation thicknesses can be connected simultaneously in the same, single terminal. Advantageously, additional circuitry, such as protective devices, can also be incorporated integrally into the terminal, as desired.

In a preferred embodiment, the terminal includes a series of teeth configured for receiving a conductor therealong. A separate surface is juxtaposable in a position opposite the teeth such that, at least in the region in which the conductor (wire) is positioned, the teeth present a sequence defining a progressive taper toward the surface (or vice versa) such that the conductor is progressively engaged between the teeth and the surface. In the preferred embodiment, the teeth are on a stationary planar support and the surface is on the planar end of a cap which can be rotated into position opposite the teeth. Further, the preferred cap has a series of concentric ridges on that same cap end surface which function as insulation displacing means for making an electrical connection to the conductor. As the ridges penetrate the insulation on the wire, the opposing teeth then prevent the wire from turning beneath the cap. However, while not presently preferred, it will be understood that the concentric ridges on the base of the cap could themselves be considered to be the teeth, and the plate opposite the cap could be smooth and then could be considered to be the surface which is juxtaposable opposite the teeth. In the broadest sense, these are conceptually analogous. Further, where the members are to be snapped together rather than rotated together, it will be understood that the teeth and the surface need not be planar.

However, the preferred embodiment has the particular advantage that the teeth and cap both penetrate the insulation and make direct contact with the wire without requiring pre-stripping of the insulation by the installer. Due to the tapered clearance between the cap and the toothed plate, thinner wires will be penetrated in the zone of closest approach between the teeth and the opposed ridged surface on the bottom of the cap, while thicker wires will be penetrated in the wider area. In both cases, full strain relief and support will be provided for the wires. Describing the conditions in the transition from the wider portion of the taper inwardly toward the narrower portion, the teeth and ridges will first physically engage the insulation to provide strength, support, and stress relief. As the taper narrows, the wire is penetrated but is not significantly deformed, so that electrical contact is made and physical support is given. In the narrowest portion of the taper, thin wires will not be significantly deformed but thicker wires will be. However, the physical support afforded earlier in the wider portion of the taper means that the deformation (crushing) of thicker wires in the narrow portion of the taper is of no consequence to the physical strength afforded by the terminal connection.

As should now become apparent, the present invention is enormously versatile. With a toothed plate and cap which are reasonably large, many wires can simultaneously be placed along the toothed plate and simultaneously engaged, regardless of the individual sizes of each wire, since each connection is afforded by each particular wire's zone on the toothed plate and not affected by the others. Further, by establishing different taper zones on the plate, wires can be accommodated which differ enormously in size, or which enter from correspondingly different directions. Thus, wires entering from opposite sides of the terminal block can be easily accommodated by a single terminal.

In the preferred embodiment, the cap includes a threaded portion which guides it into the proper taper-forming position relative to the teeth. The cap is thus the active, and usually removable, element in a terminal block configuration. Accordingly, the present invention further provides for furnishing more than one cap configuration according to the needs of the particular terminal connection being made. Active circuitry can be incorporated into the cap and selected as desired. Many terminal connections must presently include over-voltage and/or over-current protective circuitry, and the present invention provides for incorporating such circuitry directly into the caps. The active circuitry could also include active electronic components (e.g., amplifiers, fault detectors, etc.) as desired. Thus a standardized terminal block can be used, and circuitry can be selectively supplied, as appropriate, simply through the choice of a correspondingly equipped cap.

It is therefore an object of the present invention to provide new and improved methods and apparatus for use in telecommunications terminals for accommodating wires and conductors having widely varying thicknesses and widely varying insulating coatings; such methods and apparatus which can quickly and reliably make connections to such conductors without the need to remove insulation therefrom; which will provide integral stress and strain relief for such conductors; which include a series of teeth, a surface juxtaposable in a predetermined position opposite the teeth, and tapering means cooperating with at least a region of the teeth for presenting a sequence thereof which defines a substantially progressive taper toward the surface when in the predetermined position, for progressively engaging a conductor located therebetween; in which the series and the surface may define non-parallel planes; in which the teeth may be conductive; which may include support means supporting the teeth thereon; in which such a support means may be a metallic plate incorporating the teeth therein; in which the tapering means may be a taper in the effective thickness of such a plate; in which the teeth may be aligned substantially transversely to the strike of such a plate from thick to thin; which may include at least one electrical connection tab extending from such a plate for connection to electrical circuit or test apparatus; in which such a support means may be a base member; in which the teeth may be a toothed metallic plate supported on such a base member; in which such a base member may be a terminal block extending laterally beyond such a toothed plate; in which such a base member may be a printed circuit board extending laterally beyond such a toothed plate; which may include a plug and/or a socket mounted on such a printed circuit board for connecting a cable thereto; in which the tapering means may be a taper in the effective thickness of such a plate for defining two substantially planar, non-parallel surfaces on the plate, one of these surfaces supporting the teeth thereon; in which the teeth may be aligned substantially transversely to the strike of such a plate from thick to thin; in which the tapering means may be a sloped region on a portion of a surface of such a base member for supporting the teeth thereon non-parallel to the juxtaposable surface; in which the teeth may be a plurality of groups of teeth, the teeth in each particular group having substantially the same dimensions, and the dimensions varying from one group to another; in which the teeth may be configured in substantially parallel, substantially straight ridges; which may include positioning means for maintaining the surface in the predetermined position; in which such a positioning means may be a boss connected to the teeth and/or a boss connected to the surface for limiting the distance between the teeth and the surface to a predetermined minimum distance; in which the surface may be conductive; which may include insulation displacing means on the surface for penetrating insulated conductors engaged between the surface and the teeth; which may include a substantially cylindrical cap supporting the surface on one end thereof; which may include electrical protector means incorporated in such a cap; which may include positioning means for positioning such a cap with the surface in the predetermined position; in which such a cap positioning means may include means for rotatably supporting the cap with the surface in substantially the predetermined position; in which such a cap positioning means may include means for screwing the cap into the predetermined position; which may include insulation displacing means on the surface of such a cap for penetrating the insulation on insulated conductors located between the surface and the teeth; in which such insulation displacing means may be a plurality of concentric ridges; in which such insulation displacing means may be metallic; in which such positioning means may include means for screwing such a cap into the predetermined position to cause such insulation displacing means to penetrate the insulation on any such insulated conductors and to make electrical contact therewith; in which such insulation displacing means may be a plurality of ridges which are concentric about the axis of rotation around which such a cap is screwed into the predetermined position; which may include electrical protector means incorporated in such a cap; in which such an electrical protector means may include means for shunting such an insulation displacing means to ground when a predetermined voltage and/or a predetermined current is exceeded; in which such a terminal block may have at least one port within the block positioned for admitting at least one wire into the block for engagement between the surface and the teeth; which may include electrical test access means in such a terminal block for electrically testing the terminals; in which either the teeth series or the surface may be located within such a terminal block; which may include a port within such a block for admitting the other of the teeth series or the surface into the block for positioning them in the predetermined position; which may include positioning means in such a block for removably maintaining the other of the teeth series or the surface in the block; in which such a substantially cylindrical cap may support the other of the teeth series or the surface on one end thereof; which may include a plurality of additional ports which may have different sizes; in which such a plurality of additional ports may be located on at least two different sides or substantially all on the same side of such a block; in which such additional ports may be located for admitting such wires such that at least some of those wires may be engaged, respectively, with the same terminal; in which such additional ports may be located for admitting such wires such that at least some of those wires admitted from different sides of such a block may be engaged, respectively, with the same terminal; in which such additional ports may be located for admitting such wires such that at least some of those wires may be engaged, respectively, with different terminals; in which the tapering means may include another region of the teeth for presenting a second sequence thereof which defines a second substantially progressive taper toward the surface which is different from the first taper; in which the series of teeth may include at least two regions wherein the progressive dimensions of the teeth in one such region are different from those in the other, and wherein the tapering means defines different progressive tapers at least in part due to the differences in such progressive dimensions; which may include a splitter associated with such a port for splitting a multi-conductor cable in conjunction with insertion of such a cable into such a port; in which the port associated with such a splitter may be bifurcated at its entrance; in which such a splitter may be located at the bifurcation of such a port for splitting such a multi-conductor cable as it enters the branches of the bifurcation; in which such a splitter may be metal-edged; in which such a terminal block may be modular; in which such a terminal block may be a network interface device; in which such a network interface device may include a test port socket, a cover for the socket, a coupling plug in the cover for closing the circuit electrically through the network interface device when the cover is positioned over the socket, threaded attachment means for screwing the cover onto the network interface device over the socket and holding the cover thereon, and rotatable attachment means for retaining the plug in the cover and permitting the cover to rotate relative to the plug as the cover is being screwed on or off of the network interface device; in which one or more of the terminals may be incorporated into a terminal block adapter; in which such a terminal block adapter may include a collar for reception onto a terminal block binding post; in which either the teeth series or the surface may be supported by such a collar and a cap may support the other of the teeth series or the surface, the cap having means for engaging such a binding post and positioning the teeth series and the surface in the predetermined position; in which the teeth series and the surface in such a terminal block adapter may be within the collar when in the predetermined position, and a port within the collar may admit at least one wire into the collar for engagement between the surface and the teeth; in which such a terminal block adapter may include means for completing an electrical connection between such a wire and such a binding post when the binding post is conductive; and to accomplish the above objects and purposes in an inexpensive, uncomplicated, durable, versatile, and reliable method and apparatus, inexpensive to manufacture, and readily suited to the widest possible utilization in the telecommunications industry.

These and other objects and advantages of the invention will be apparent from the following description, the accompanying drawings, and the appended claims.

BRIEF DESCRIPTION OF THE DRAWINGS

FIG. 1 is a fragmentary, exploded, isometric view of a preferred embodiment of a terminal according to the present invention, showing the active surface of the terminal's toothed plate, the terminal cap, and an associated printed circuit board;

FIG. 2 is a fragmentary cross-sectional view showing the FIG. 1 components assembled into a terminal and mechanically and electrically terminating an unstripped wire;

FIG. 3 is a bottom view of the cap taken on view line 3—3 in FIG. 1;

FIG. 7 illustrates a second embodiment of the cap in which over-voltage and over-current protective elements have been incorporated;

FIG. 8 is a cross-sectional view taken on line 8—8 in FIG. 7;

FIG. 9 is a view similar to FIG. 7 showing the protective elements activated by an over-current condition;

FIG. 11 is a somewhat figurative cross-sectional view of a terminal block such as shown in FIG. 10, illustrating access to a circuit testing tab attached to the terminal;

FIG. 12 is a fragmentary cross-sectional view taken on line 12—12 of FIG. 11, illustrating the selective use of caps in which some contain active circuit elements and others do not;

FIG. 17 is a partially exploded isometric view of another terminal block embodiment in which multiple access ports for wires of different sizes are provided for each terminal;

FIG. 18 is a cross-sectional view of the FIG. 17 terminal block;

FIGS. 19 and 20 show an embodiment similar to that shown in FIGS. 1–3, wherein the toothed plate includes an additional tab;

FIGS. 21 and 22 illustrate a modified toothed plate having integral bosses for defining the proper distance between the teeth and the bottom surface of the cap;

FIG. 27 is an exploded isometric view of another terminal block embodiment in which the toothed plate is split for connection to wires coming from opposite directions;

FIG. 28 is a cross-sectional view of the FIG. 27 block showing wires accommodated from opposite directions;

FIG. 29 is an enlarged perspective view of the toothed plate shown in FIGS. 27 and 28;

FIG. 31 is a partially-sectioned view of the FIG. 30 adaptor connecting wires to such a prior art block;

FIG. 32 is a cross-sectional view taken on line 32—32 in FIG. 31;

FIG. 33 is a view from beneath the upper portion of the adaptor collar shown in FIGS. 30-32;

DESCRIPTION OF THE PREFERRED EMBODIMENTS

Figure 4:
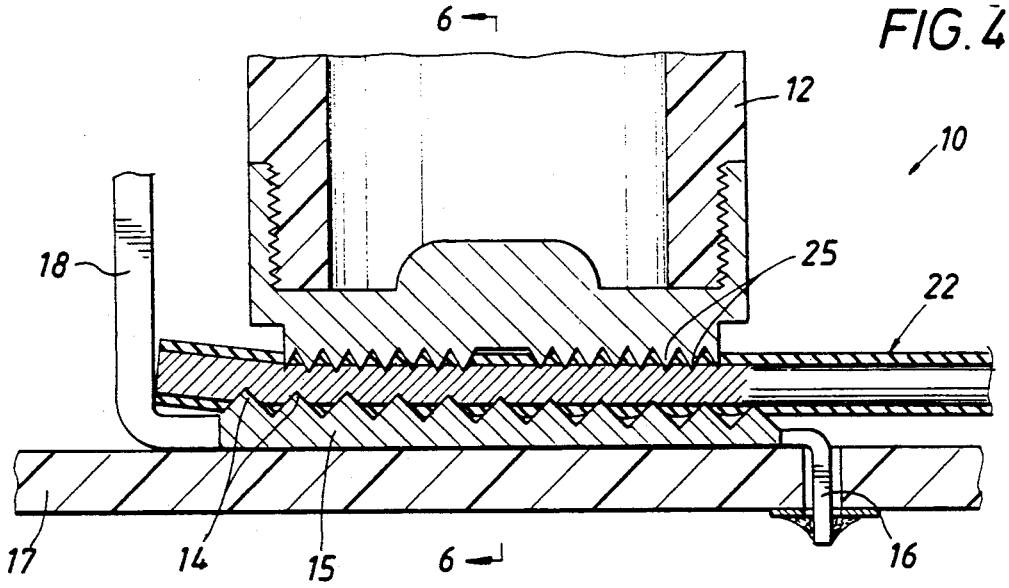
FIGS. 4–6 are fragmentary cross-sectional views of the FIG. 2 assembly in which a thick and a thin wire are shown being simultaneously connected in the same terminal, the thicker wire being shown in FIG. 4 and the thinner in FIG. 5, FIG. 6 being taken on section lines 6—6 in FIGS. 4 and 5, the sections of the cap and teeth in FIGS. 4 and 5 being through the cap center, for clarity of illustration, and the wires being sectioned on lines 4—4 and 5—5, respectively, in FIG. 6.

With reference to the drawings, the new and improved telecommunications terminal, terminal block, and method therefor according to the present invention, will now be described. FIG. 1 shows a preferred embodiment 10 of the present invention, including a cap 12 and a series of teeth 14. In the preferred embodiment, the teeth 14 are stamped onto one surface of a plate 15. Tabs 16 extending from plate 15 facilitate mounting the plate on a printed circuit (PC) board 17 and connecting electrically to it, as shown in FIG. 2. A test tab 18 on plate 15 facilitates testing of electrical circuits connected to the plate, as suggested by the alligator clip connected to a similar test tab in FIG. 11.

FIG. 2 shows the cap 12, toothed plate 15, and PC board 17 in position beneath and adjacent the top panel 20 of a terminal block. An insulated wire 22 is shown captured in the terminal (cap 12 and teeth 14), the teeth gripping the wire and insulation, and penetrating the wire to make contact with it. The main insulation displacing and connecting function is provided, however, by a series of ridges 25 (FIG. 3) on the bottom of cap 12 spaced from the teeth 14. As the cap 12 is screwed through panel 20 on threads 26, it is driven down toward teeth 14. The rotation of the ridges 25 causes them to cut through the insulation on wire 22 to make contact with the wire. The ridges 25 then join the teeth 14 in gripping the wire and insulation to provide physical strength and strain relief for the connection. Also, as cap 12 is rotated, teeth 14 hold wire 22 in place so that it does not twist underneath the cap 12. A rim 29 on cap 12 limits the distance to which the cap 12 can be screwed into the terminal block panel 20, thus establishing the spacing between the teeth 14 and the bottom surface of the cap 12 defined by the ridges 25.

Figure 5:
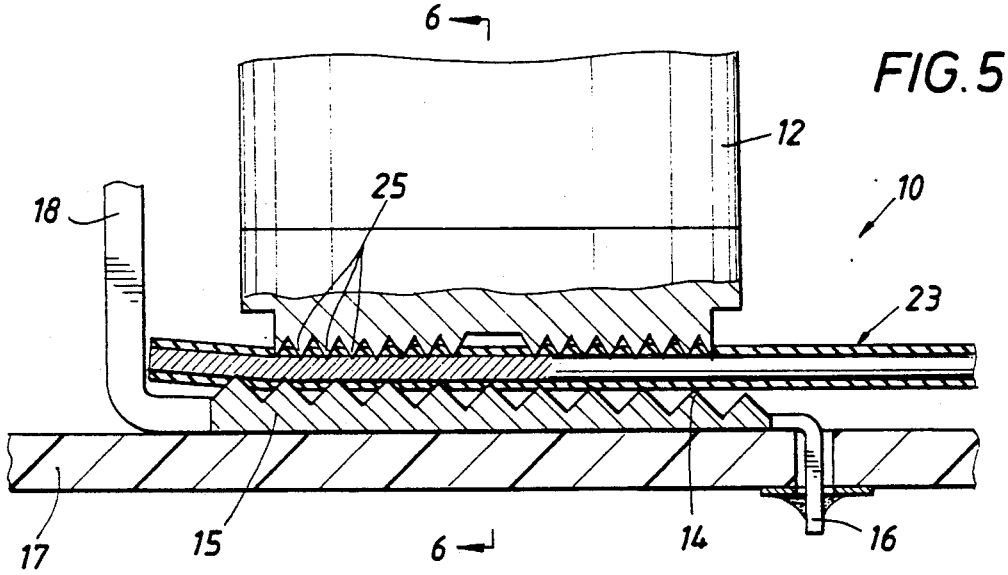
Figure 6:
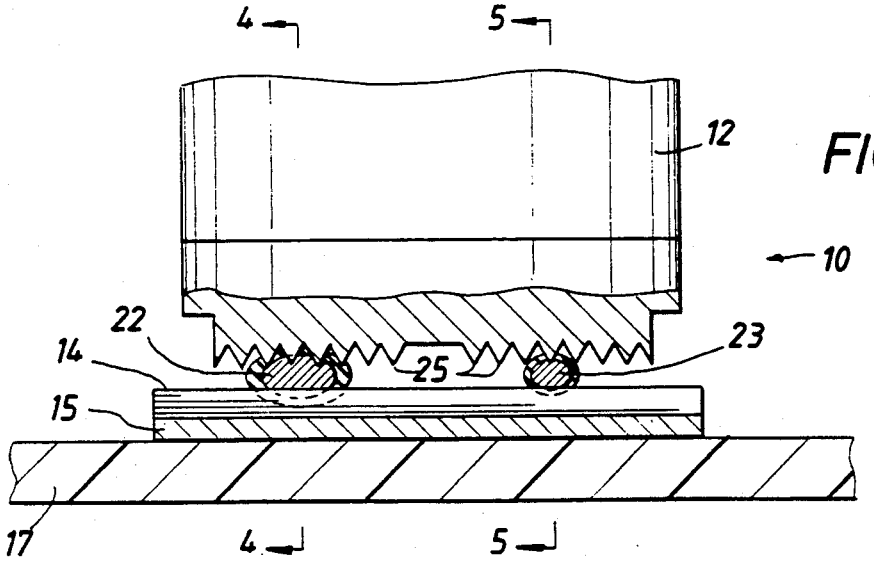

A careful examination of FIGS. 4-6 shows that the thickness of plate 15 tapers from thin to thick in the direction in which the wire has been inserted (from right to left as shown in these figures). Thus the plane defined by the teeth 14 and the plane defined by the ridges 25 define a progressive taper of the teeth toward the ridged bottom surface 25 of the cap 12, which, as clearly shown in FIGS. 4-6, progressively engages the conductor or wire located in between. FIGS. 4 and 6 show a thick wire 22 and FIGS. 5 and 6 show a thinner wire 23, both simultaneously captured, fully contacted, and fully supported by the single terminal 10. In the case of the thick wire 22 (FIG. 4), the insulation is gripped and the wire is contacted toward the wider portion of the taper (to the right in FIG. 4), so that any distortion and/or damage to the wire in the narrower portion (toward the left) is inconsequential. With regard to the thinner wire (FIG. 5), the wider portion of the taper has little if any effect upon the wire or the insulation, while the narrower portion fully engages and supports the wire and insulation for electrical contact and physical strength, similarly as the thicker wire was contacted and supported. As will immediately be evident, additional wires may also be accommodated, the limitation on thickness being determined only by the dimensions and extent of the taper itself. Thus, to establish contact, no more is required than to insert as many wires as desired, regardless of gauge, and generally in parallel along the series of teeth 14, and then to screw the cap 12 down into position opposite the teeth.

FIG. 7 shows a second embodiment 35 similar to embodiment 10 (FIGS. 1-3), except that the cap 37 of embodiment 35 has been lengthened in order to incorporate a standard electrical protection assembly 38. As is known in the art, assembly 38 includes a gas discharge tube 41 for protecting against sudden high voltages, and a fusible element 42 for protecting against excessive currents. FIG. 9 illustrates the response of the protection assembly 38 to the latter condition, wherein the fusible element has melted and the spring 44 has driven the gas discharge tube 41 down to ground the circuit from the ridged end plate 25 of the cap 37. Completion of the circuit to ground is through a ground plate 45 adjacent the terminal block top panel 46, both threaded for receiving the threads 47 on cap 37. Note that, while the body of cap 37 is of non-conductive material, the portion of the cap adjacent spring 44 includes a metallic insert 48 (FIG. 8) for completing the circuit from the spring 44 to the ground plate 45. As can be seen in FIGS. 8 and 12, insert 48 is oblong so that the upper and lower non-conductive portions of cap 37 remain connected by linking webs 49 for integrity and tortional strength. Of course, embodiment 35 may be dimensioned to any size which is appropriate for the included circuitry, including a reduced size for solid state circuitry, if desired.

Figure 10:
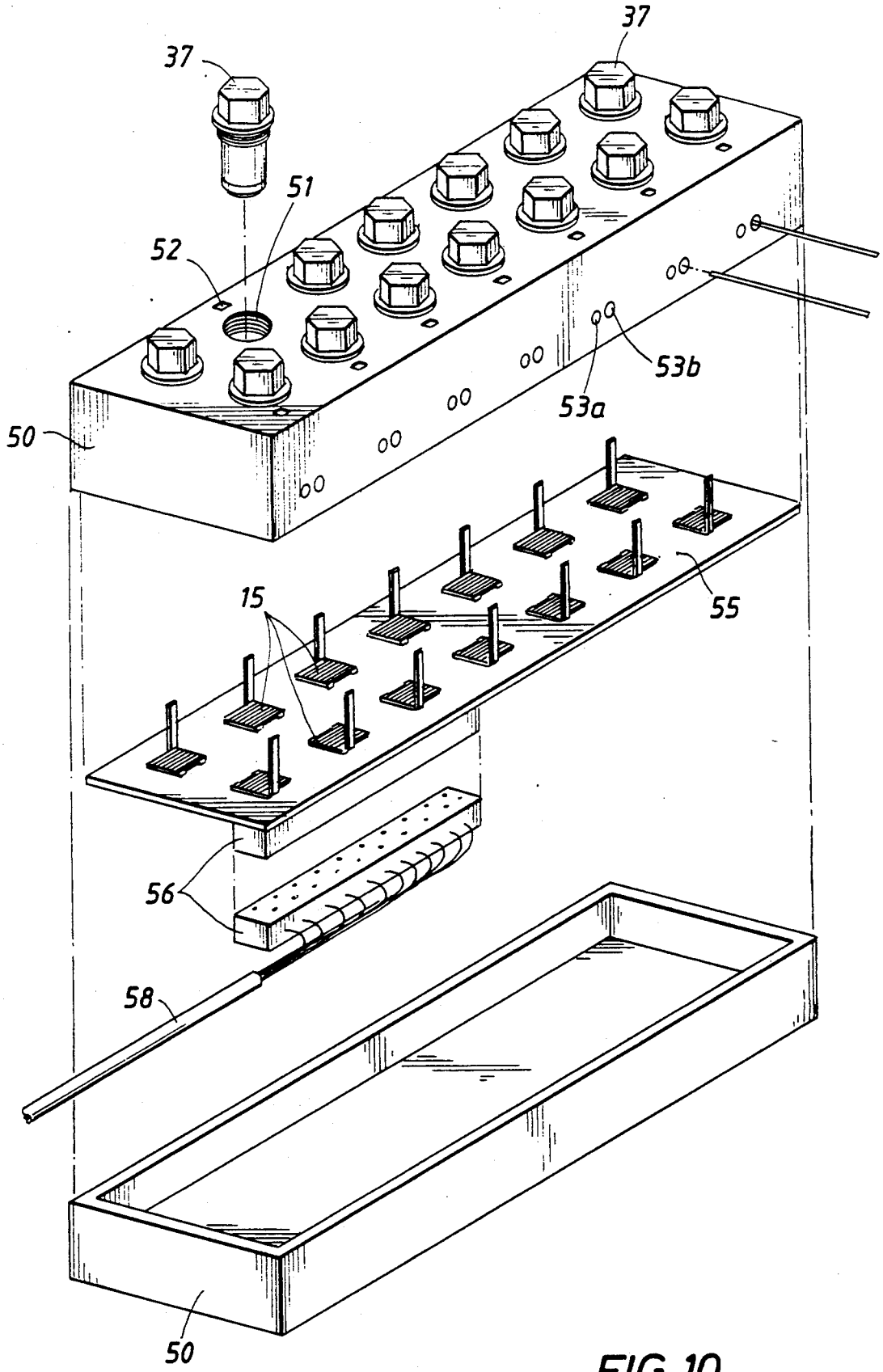
FIG. 10 is an exploded, isometric view showing multiple terminals incorporated into a terminal block having a printed circuit board therein.
Figure 13:
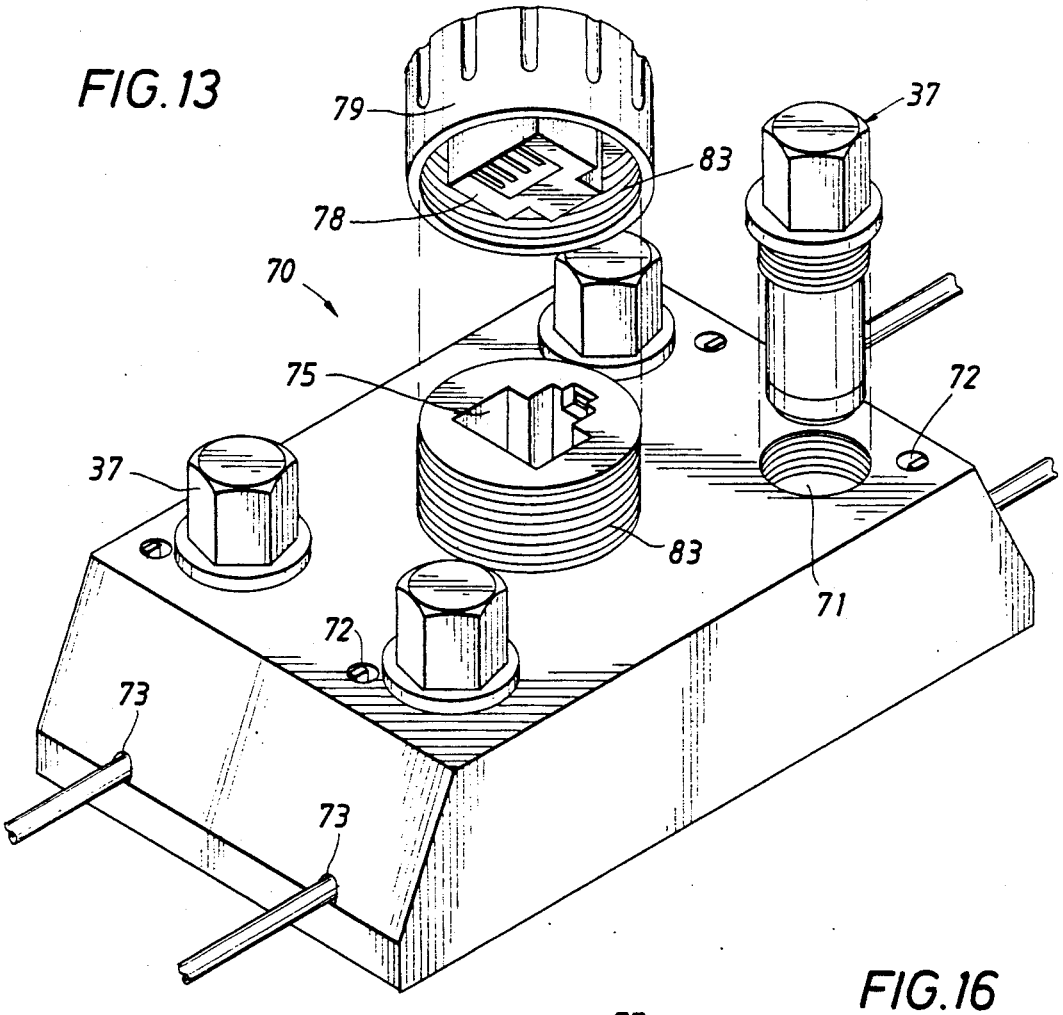
FIG. 13 is a partially exploded, isometric view of a network interface device incorporating terminals according to the present invention, and also having an automatic circuit isolation and testing socket.
Figure 16:
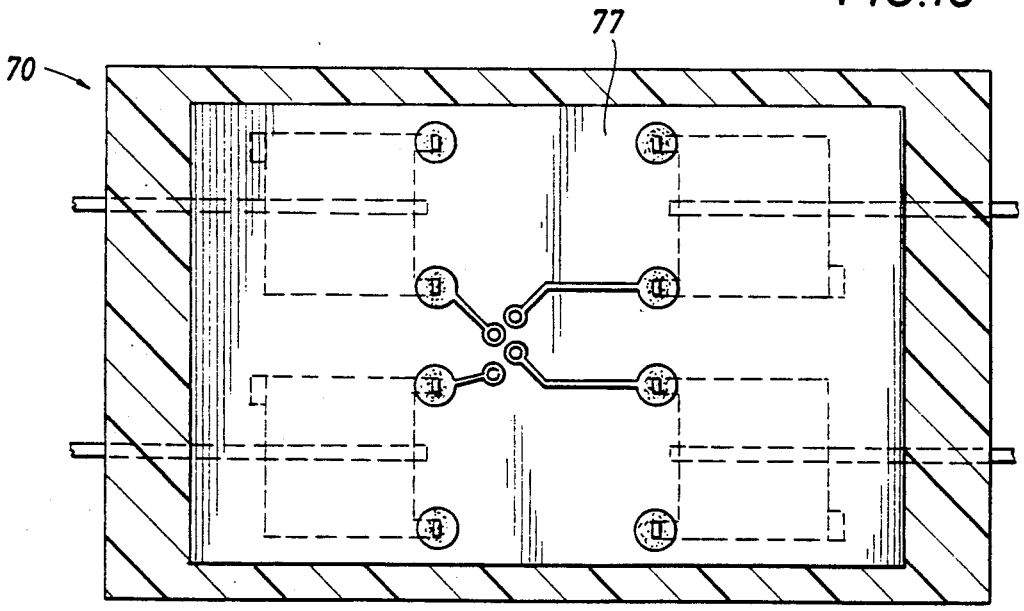
FIG. 16 is a bottom view of the circuit board of the FIG. 13 device, taken on section line 16—16 in FIG. 14.

FIGS. 10-12 illustrate the invention incorporated into a terminal block 50. Block 50 includes several ports: ports 51 for receiving the caps 37, test ports 52, and wire access ports 53*a* and *b* which may be sized appropriately for the wires being connected to the block. As shown, ports 53*b* are for larger diameter wires than ports 53*a*. The toothed plates 15 are received on a printed circuit board 55 which may have a plug and socket assembly 56 for connection to an external cable 58.

FIG. 11 shows the FIG. 10 embodiment with a test clip 61 accessing one of the test tabs 18 of the toothed plate 15. FIG. 12 shows block 50 provided with several caps 37 having protector assemblies 38 therein, and other caps not so provided, thus illustrating the versatility of the present invention and the ease with which the installer may equip individual circuits with the services and features appropriate thereto. It will also be appreciated that, in the event that a protective assembly 38 is activated, as shown in FIG. 9, the cap 37 can be quickly removed and replaced with a new cap and protector assembly as soon as the circuit defect has been rectified.

Figure 14:
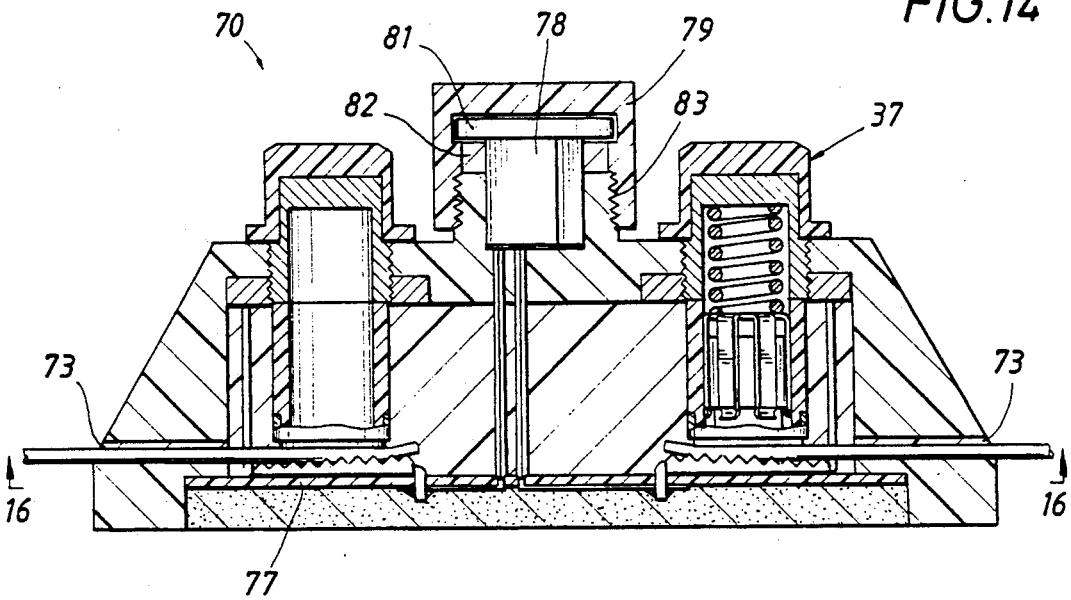
FIG. 14 is a cross-sectional view of the FIG. 13 embodiment in which the cap is screwed down onto the interface device;.
Figure 15:
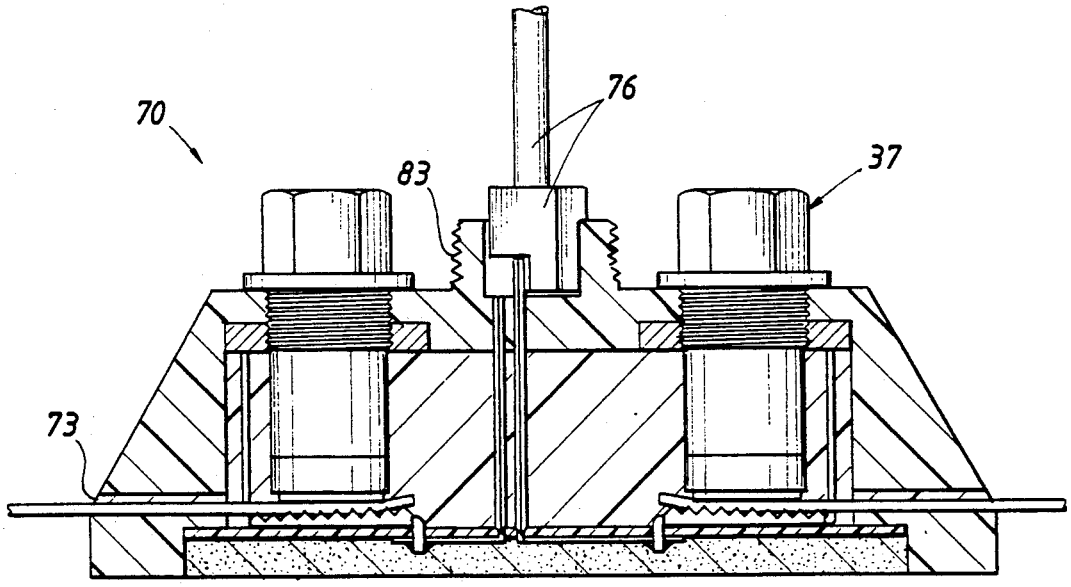
FIG. 15 is a view similar to FIG. 14 showing the cap removed and a test plug inserted.

FIGS. 13–16 illustrate a network interface device (NID) 70 in which, "protected" and "unprotected" caps 37 (see FIG. 14) may again be selectively employed, as required by local ordinance or as desired by the installer. In addition to the cap, test, and wire access ports 71–73, respectively, NID 70 also includes an automatic circuit isolation and test socket 75. In the preferred embodiment, socket 75 is a standard RJ-11 socket which can receive a standard test plug and line 76 (FIG. 15) for testing the circuit connected thereto. In the normal service configuration, the circuit through the NID is completed in part by a printed circuit board 77 connected to the test socket 75. The balance of the circuit is closed by an RJ-11 plug 78 which is physically captured, but free to rotate, within a covering cap 79. That is, as shown in FIG. 14, the RJ-11 plug 78 has a rim 81 which snaps into cap 79 behind a boss 82 at the top of the threads 83 by which cap 79 is screwed onto NID 70. Thus, when the cap 79 is fully screwed into position on NID 70, the RJ-11 plug 78 is received in test socket 75 and, being appropriately connected internally, automatically completes the circuit through the NID 70 for normal service. When removed, the cap 79 and plug 78 likewise automatically isolate the local circuit from the network for testing. Use of an RJ-11 plug in a NID is also shown in U.S. patent application Ser. No. 07/584,325, filed Sept. 17, 1990, and assigned to the assignee of the present invention.

FIGS. 17 and 18 illustrate a terminal block 85 which again may use protected or unprotected caps, and which connects pairs of wires inserted through the same side of the block. Block 85 illustrates a variation for receiving wires having very thick insulation, and wherein it is desired to remove the insulation rather than to use a steeper taper to accommodate it. An example might be the connection of an 18–½ gauge copper coated steel aerial dropwire 86 (F-drop) to a 24 gauge household circuit wire 87. The F-drop 86 might preferably have its thicker outer insulation removed since engaging the insulation is not necessary to provide adequate strength and strain relief for that wire, and the shallower taper which this affords will provide a longer range of engagement on the 24 gauge wire 87 and its insulation, where such strain relief may be more important. Also shown in block 85 is a modified test port 88 through which a lengthened probe is inserted to make contact with a horizontal test tab 89.

FIGS. 19 and 20 show a modified toothed plate 95 similar to plate 15 (FIG. 1), except that it includes an additional tab 96.

Figure 23:
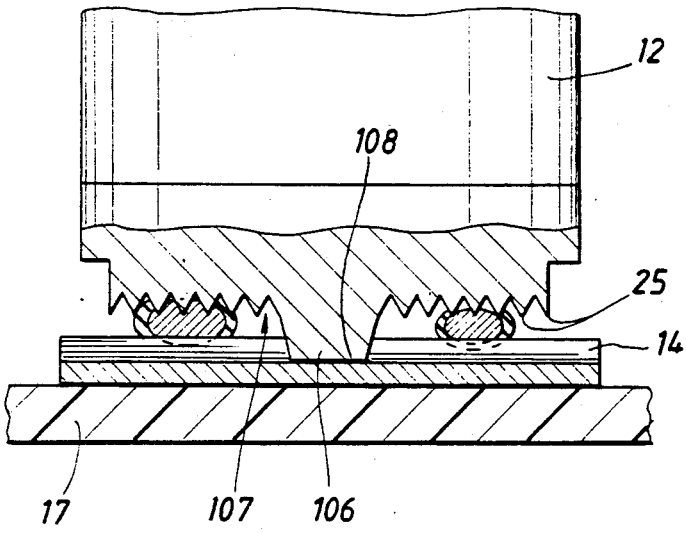
FIGS. 23–24 illustrate still another embodiment in which a boss on the ridged IDC cap surface limits the distance between that surface and the teeth to the proper separation.
Figure 24:
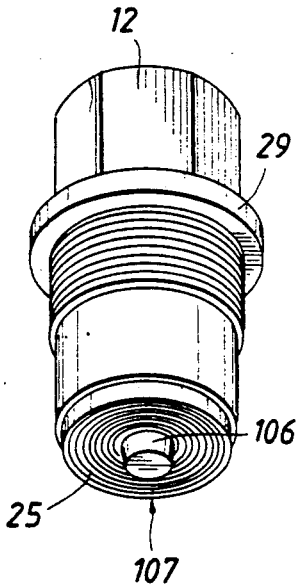

For most telecommunications applications, the distance between the teeth and the cap surface should range from about 0.008 inches to about 0.012 inches. In the embodiment thus far illustrated, that distance is a pre-determined relative position established by the rims on the caps, such as rim 29 (FIG. 2), as they abut the tops of the terminal blocks, such as the terminal block top panel 20 (FIG. 2). Referring to FIGS. 21 and 22, a more precise spacing between the teeth and the plate surface is maintained by bosses 101 on the sides of a modified toothed plate 102. When the ridged surface 104 is moved into its preferred position opposite plate 102, it will contact the bosses 101, establishing and limiting the operative gap between them to the precise dimension desired. This eliminates slight variations which might occur due to flexing of the assemblies upon which the terminal is mounted, such as, for example, a printed circuit board or the terminal block top housing panel. Similarly, FIGS. 23 and 24 illustrate an alternative positioning means wherein a boss 106 on the cap surface 107 controls and limits the spacing between the cap surface 107 and the toothed plate 15. Boss 106 may rest on top of the teeth 14, or may be received in a flat spot 108 on the plate surface.

Figure 25:
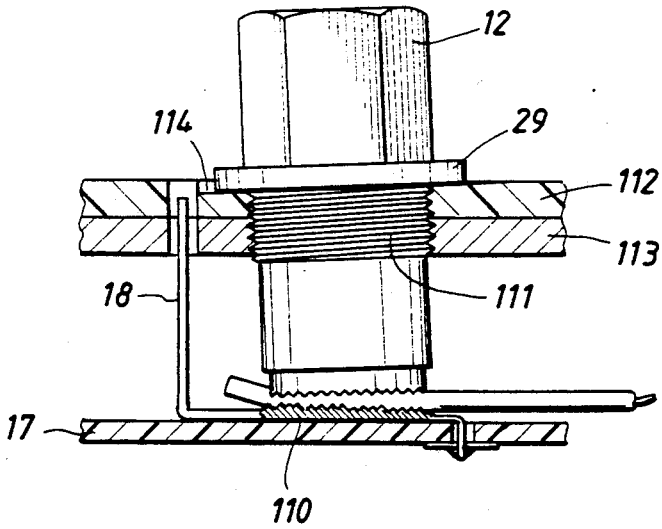
FIG. 25 is an illustration similar to FIG. 2 of another embodiment in which the thickness of the toothed plate is substantially uniform and the taper between the plate and the cap is provided by canted threads in the terminal block which support the cap at an angle relative to the block and the toothed plate.

FIG. 25 illustrates another aspect of the versatility of the present invention. In FIG. 25 it is clear that the operative feature of the present invention has to do with the tapered gap between the toothed plate and the cap surface, irrespective of how that taper is accomplished. Thus, while the preferred embodiment employs a toothed plate with a thickness which varies from thin to thick in the direction of the wire insertion, it is fully plausible to use a toothed plate of substantially uniform thickness, and instead to cant the cap at an angle with respect thereto. Thus, the toothed plate 110 in FIG. 25 has a substantially uniform thickness. The threads 111 in the terminal block top panel 112 and grounding plate 113, therefore, are cut on a bias so that the cap 37 is canted or tilted. Preferably, the region of the top panel 112 around the rim 29 of cap 37 will have a depression 114 which is sloped at an angle corresponding to the tilt caused by the threads 111. Depression 114 thus constitutes a sloped region on a portion of the surface of top panel 112 for supporting the ridged end 25 thereof nonparallel to the surface defined by the toothed plate 110.

Figure 26:
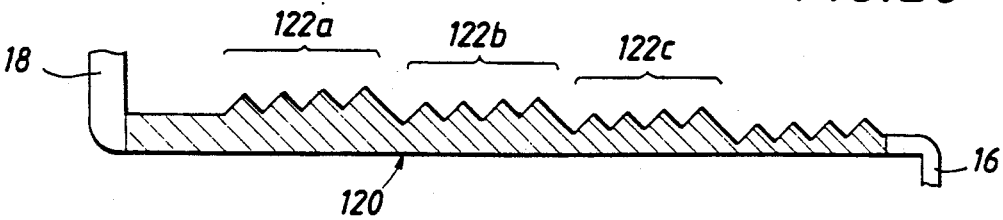
FIG. 26 is an exaggerated cross-sectional view of a toothed plate showing a preferred embodiment in which the teeth, while presenting a progressive taper overall, are arranged in smaller groups in each of which the teeth are spaced approximately equally from the opposing cap surface.
Figure 30:
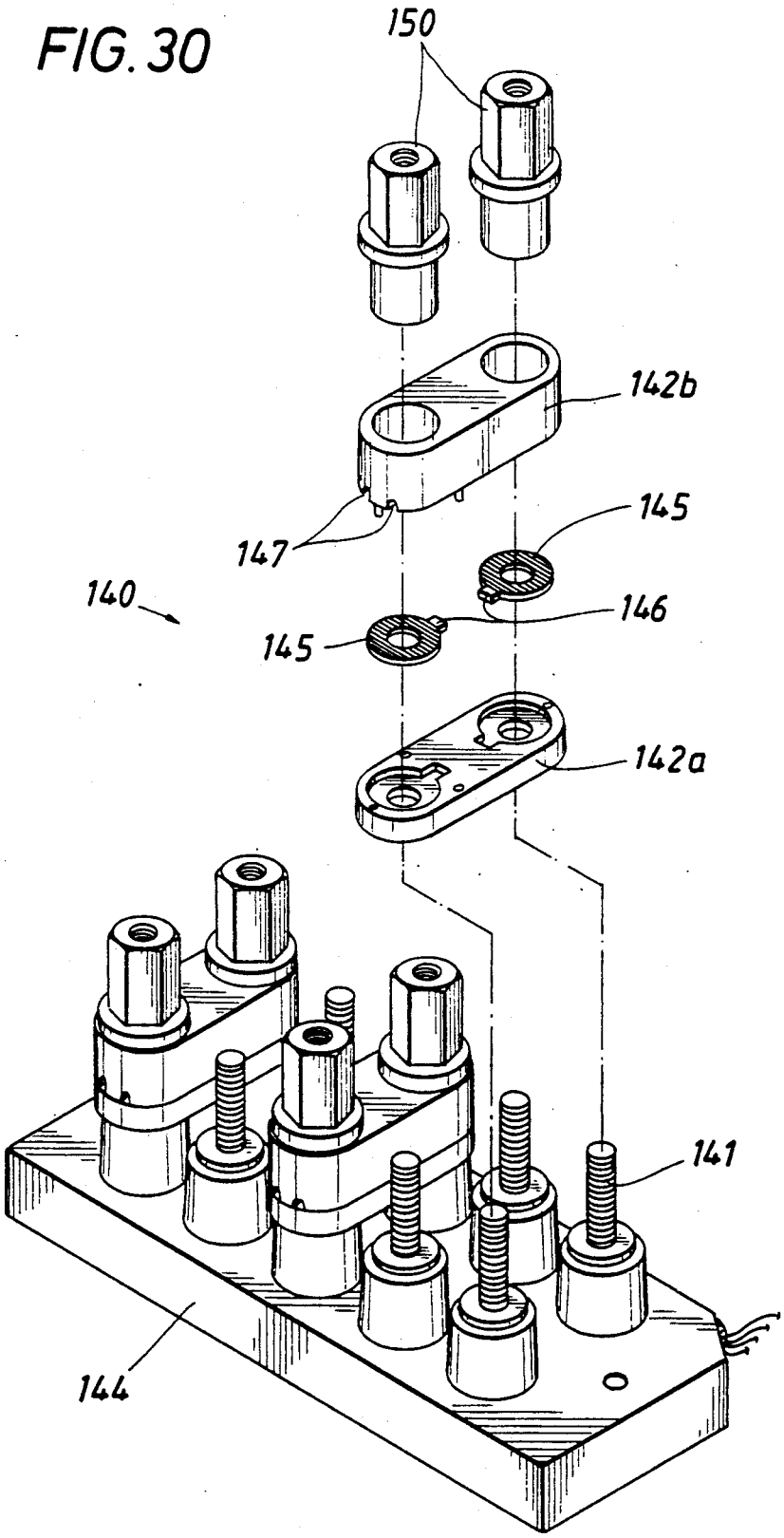
FIG. 30 is a partially exploded isometric view of a terminal block adaptor and a prior art terminal block, for connecting wires to such a prior art block using terminals of the present invention.

FIG. 26 shows, in exaggerated detail, a preferred embodiment of a toothed plate 120, in which the spacing and sizes of the teeth are optimized in groups for each of the anticipated wire sizes. Thus, rather than having a uniform taper from one end to the other, the taper occurs in a somewhat step-wise fashion. Along the plate surface are groups of teeth 122*a, b*, etc. Within each group the teeth are of substantially the same height and dimensions, optimized for a particular wire size. The next group is then optimized for the next wire dimension, and so forth.

FIGS. 27–29 illustrate a terminal block 125 in which the toothed plates 130 are optimized for wire entry from opposite sides of the block. In this case, the toothed plates 130 have split, oppositely sloped ramps of teeth 131 and 132, going from lower to higher, respectively, for the directions in which their respective wires are to be inserted. The corresponding wire insertion ports 133 and 134 are therefore suitably positioned, slightly offset from one another, to guide the wires respectively onto their corresponding ramps 131 and 132. As will be appreciated, these wires are then fully connected and supported in a single terminal with a single quickly and easily performed operation.

FIGS. 30–33 illustrate a terminal block adaptor 140 for use with existing terminal blocks in order to make connection thereto using the improvements of the present invention. Thus, rather than stripping the wire and shaping it appropriately beneath a nut on the old binding post 141, adaptor 140 can be quickly placed over the binding post 141 and then the insulated wire or wires, as desired, can be quickly and reliably connected and secured in the same manner described heretofore. More particularly, a collar 142 having lower and upper portions 142*a* and *b* is engaged over the binding posts 141 of the prior art terminal block 144. Toothed plates 145, having indexing tabs 146 to keep the ramp slopes properly oriented, are contained within the collar 142 for receiving wires inserted through ports 147. A conductive cap 150, threaded through the middle, (which may optionally have exterior insulation, not shown) is then screwed onto each binding post in order to engage the posts and position the ridged cap bottom surface 151 in the appropriate position relative to its corresponding toothed plate 145. Other types of IDC type terminal block adaptors, not teaching a toothed and tapered terminal as taught by the present invention, may be found, for example, in U.S. patent application Ser. No. 07/584,325, filed Sept. 17, 1990, and assigned to the assignee of the present invention, the disclosure of which is fully incorporated herein by reference for all purposes.

Figure 34:
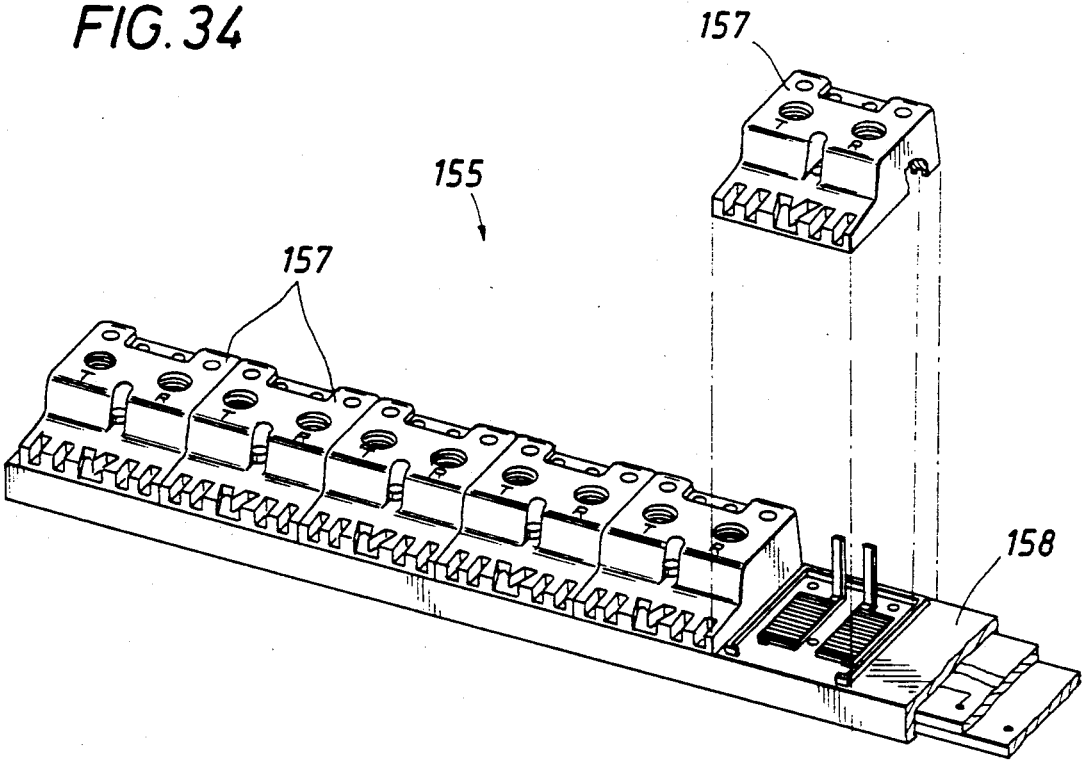
FIG. 34 is a perspective, partially exploded view showing a terminal block assembly incorporating modules according to the module shown in FIG. 35.
Figure 35:
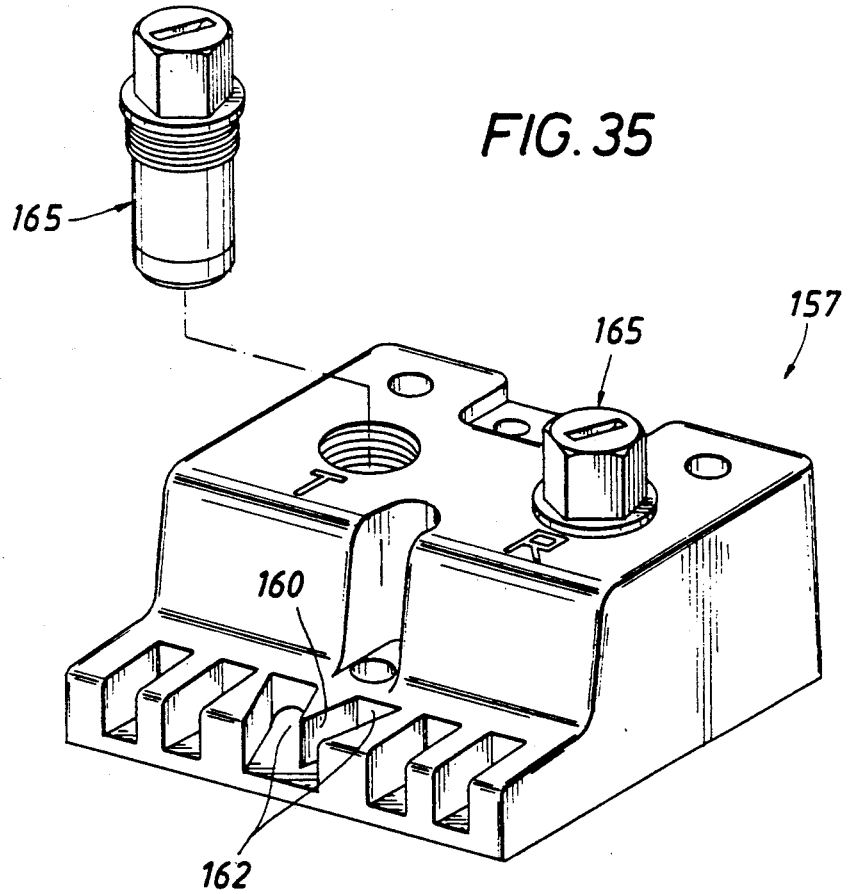
FIG. 35 is a perspective view of a module for a modular terminal block assembly, in which one of the wire entrance ports includes a splitter for splitting a multiconductor cable as it is inserted into the module.

FIGS. 34–35 illustrate a modular terminal block assembly 155 incorporating terminals according to the present invention. In this embodiment, individual modules 157 are attached to a baseplate 158. This has the advantage of minimizing the number of parts necessary for offering a wide range of terminal block sizes and capacities. The modules 157 are identical whether or not the total assembly is sized for two circuits or twenty. A range of baseplates 158 is then provided as desired. It will also be noted that the modules 157 incorporate a metal edge splitter 160 for splitting two-conductor cables as they are inserted into the adjacent bifurcated port 162 of the module for connection beneath the terminal caps 165.

As may be seen, therefore, the present invention provides numerous advantages. Principally, it furnishes an extremely versatile terminal for telecommunications applications which can quickly, easily, and reliably make simultaneous multiple connections to insulated conductors of a wide range of gauges and insulation thicknesses. The previously described embodiments and the several terminal blocks in which they are incorporated will now be understood by practitioners in the art to be but a small sample of the versatility of the present invention and the range of applications in which it may be employed.

Various modifications to the present invention will therefore occur to those skilled in the art upon reading the present disclosure. For example, the series of teeth and the opposing juxtaposable surface may be positioned by a quarter-turn bayonet socket, or may be snapped together. While a snap-together configuration would ordinarily require greater pressure to penetrate the insulation than is required with the rotation of the ridges in the preferred embodiment, it does have other advantages. Such an embodiment makes it additionally clear that the ridges on the opposing surface are in fact but another form of teeth. Thus, it will be seen that a "toothed" surface may be provided on either of the two members which define the tapering gap, or on both, as desired or as needed for the application at hand. Thus the teeth may be straight, circular, chevron, crossed, and so forth, as appropriate to the needs at hand.

Additionally, it will now be clear that the surfaces do not need to be planar, but in fact can be curvilinear as long as they complement each other such that the distance between them effectively defines a graduated taper, as discussed more fully herein. Of course, when one of the opposing surfaces is to be rotated, it is expected that the two surfaces will be planar. However, a pressed fit (such as a snapped together design) which would admit curvilinear surfaces, might be attractive, for example, where extraordinary strength and strain relief are contemplated.

Of course, it is also desirable to incorporate an environmental sealing material, such as a gel, into the terminals. Reference may be had, for example, to U.S. Pat. Nos. 4,600,261 and 4,634,207 (both assigned to the assignee of the present invention) which disclose the use of gels for terminal sealing applications.

Therefore, while the methods and forms of apparatus herein described constitute preferred embodiments of this invention, it is to be understood that the invention is not limited to these precise methods and forms of apparatus, and that changes may be made therein without departing from the scope of the invention.

What is claimed is:

1. A terminal, comprising:

a) a series of teeth configured for receiving a conductor therealong, b) means defining a surface juxtaposable in a predetermined position opposite said teeth, and c) tapering means cooperating with at least a region of said teeth for presenting a sequence thereof which defines a substantially progressive taper toward said surface when in said predetermined position for progressively engaging a conductor located therebetween.

2. The apparatus of claim 1 wherein said series and said surface substantially define non-parallel planes.

3. The apparatus of claim 1 wherein said teeth are conductive.

4. The apparatus of claim 1 wherein said teeth further comprise a plurality of groups of teeth the teeth in each particular group having substantially the same dimensions, and said dimensions varying from one group to another.

5. The apparatus of claim 1 wherein said surface is conductive.

6. The apparatus of claim 1 further comprising insulation displacing means on said surface for penetrating insulated conductors engaged between said surface and said teeth.

7. The apparatus of claim 1 further comprising support means supporting said teeth thereon.

8. The apparatus of claim 7 wherein:

a) said support means further comprises a base member, and b) said tapering means further comprises a sloped region on a portion of a surface of said base member for supporting said teeth thereon non-parallel to said juxtaposable surface.

9. The apparatus of claim 7 wherein said support means further comprises a metallic plate incorporating said teeth therein.

10. The apparatus of claim 9 wherein said tapering means further comprises a taper in the effective thickness of said plate.

11. The apparatus of claim 10 wherein said teeth are aligned substantially transversely to the strike of said plate from thick to thin.

12. The apparatus of claim 7 wherein:

a) said support means further comprises a base member, and b) said teeth further comprise a toothed metallic plate supported on said base member.

13. The apparatus of claim 12 wherein said base member is a terminal block extending laterally beyond said toothed plate.

14. The apparatus of claim 12 wherein said tapering means further comprises a taper in the effective thickness of said plate for defining two substantially planar, non-parallel surfaces on said plate, one of said surfaces supporting said teeth thereon.

15. The apparatus of claim 1 further comprising positioning means for maintaining said surface in said predetermined position.

16. The apparatus of claim 15 wherein said positioning means further comprises a boss connected to said surface for limiting the distance between said teeth and said surface to a predetermined minimum distance.

17. The apparatus of claim 15 wherein said positioning means further comprises a boss connected to said teeth for limiting the distance between said teeth and said surface to a predetermined minimum distance.

18. The apparatus of claim 17 wherein said base member is a printed circuit board extending laterally beyond said toothed plate.

19. The apparatus of claim 1 further comprising a substantially cylindrical cap supporting said surface on one end thereof.

20. The apparatus of claim 19 further comprising electrical protector means incorporated in said cap.

21. The apparatus of claim 19 further comprising positioning means for positioning said cap with said surface in said predetermined position.

22. The apparatus of claim 21 wherein said positioning means further comprises means for rotatably supporting said cap with said surface in substantially said predetermined position.

23. The apparatus of claim 22 further comprising insulation displacing means on said surface for penetrating the insulation on insulated conductors located between said surface and said teeth.

24. The apparatus of claim 23 wherein said insulation displacing means is metallic.

25. The apparatus of claim 24 wherein said positioning means further comprising means for screwing said cap into said predetermined position to cause said insulation displacing means to penetrate the insulation on any such insulated conductors and to make electrical contact therewith.

26. The apparatus of claim 25 wherein said insulation displacing means further comprises a plurality of ridges which are concentric about the axis of rotation around which said cap is screwed into said predetermined position.

27. The apparatus of claim 26 further comprising electrical protector means incorporated in said cap.

28. The apparatus of claim 1 further comprising a terminal block having at least one of said terminals.

29. The apparatus of claim 28 further comprising port means defining at least one port within said block positioned for admitting at least one wire into said block for engagement between said surface and said teeth.

30. The apparatus of claim 28 wherein said terminal block is modular.

31. The apparatus of claim 28 wherein one of said teeth series and said surface is located within said terminal block, and further comprising means defining a port within said block for admitting the other of said teeth series and said surface into said block for positioning them in said predtermined position.

32. The apparatus of claim 31 further comprising positioning means in said block for removably maintaining said other of said teeth series and said surface in said block.

33. The apparatus of claim 32 further comprising a substantially cylindrical cap supporting said other of said teeth series and said surface on one end thereof.

34. The apparatus of claim 33 further comprising electrical protector means incorporated in said cap.

35. The apparatus of claim 31 further comprising additional port means defining at least one additional port within said block positioned for admitting at least one wire into said block for engagement between said surface and said teeth of at least one terminal in said block.

36. The apparatus of claim 35 further comprising a pluralilty of said additional ports, said plurality having at least two different sizes.

37. The apparatus of claim 35 wherein said block has at least two sides, and further comprising a pluraltiy of said additional ports substantially all located on the same side of said block.

38. The apparatus of claim 37 further comprising means locating said additional ports for admitting such wires such that at least some of those wires may be engaged, respectively, with the same terminal.

39. The apparatus of claim 35 wherein said block has at least two sides, and further comprising a plurality of said additional ports located on at least two different sides of said block.

40. The apparatus of claim 39 further comprising means locating said additional ports for admitting such wires such that at least some of those wires may be engaged, respectively, with different said terminals.

41. The apparatus of claim 39 further comprising means locating said additional ports for admitting such wires such that at least some wires admitted from different sides of said block may be engaged with the same terminal.

42. The apparatus of claim 41 wherein in at least said same terminal:

a) said progressive taper is a first such taper, and b) said tapering means further comprises means cooperating with another region of said teeth for presenting another sequence thereof which defines a second substantially progressive taper toward said surface which is different from said first taper.

43. The apparatus of claim 42 wherein said surface of said same terminal is substantially planar.

44. The apparatus of claim 42 wherein:

a) said series of teeth further comprises at least two of said regions wherein the progressive dimensions of said teeth in one such region are different from those in the other, and b) said tapering means defines different said progressive tapers at least in part due to said differences in said progressive dimensions.

45. The apparatus of claim 35 further comprising splitter means associated with said additional port for splitting a multi-conductor cable in conjunction with insertion of such a cable into said additional port.

46. The apparatus of claim 45 wherein said additional port is bifurcated at the entrance thereto, and further comprising a metal-edged splitter at said bifurcation for splitting such a multi-conductor cable as it enters the branches of said bifurcation.

47. The apparatus of claim 28 wherein said block is a network interface device, and further comprising:

a) a test port socket on said block,
b) a cover for said socket, and
c) a coupling plug in said cover for closing the circuit electrically through said network interface device when said cover is positioned over said socket.

48. The apparatus of claim 47 further comprising:
a) threaded attachment means for screwing said cover onto said block over said socket and holding said cover thereon, and
b) rotatable attachment means for retaining said plug in said cover and permitting said cover to rotate relative to said plug as said cover is being screwed on or off of said block.

49. The apparatus of claim 1 further comprising a terminal block adapter having at least one of said terminals, said adapter further comprising:
a) a collar for reception onto a terminal block binding post, one of said teeth series and said surface being supported by said collar, and
b) cap means supporting the other of said teeth series and said surface, said cap means having means for engaging such a binding post and positioning said teeth series and said surface in said predetermined position.

50. The apparatus of claim 49 wherein said teeth series and said surface are substantially within said collar when in said predetermined position, and further comprising port means defining at least one port within said collar for admitting at least one wire into said collar for engagement between said surface and said teeth.

51. The apparatus of claim 50 further comprising means for completing an electrical connection between such a wire and such a binding post when such binding post is conductive.

52. A terminal, comprising:
a) a support,
b) a plurality of conductive teeth on a predetermined first surface of said support,
c) cap means defining a second surface juxtaposable in a predetermined position said first surface,
d) conductive insulation displacing means on said second surface for penetrating the insulation on insulated conductors located between said second surface and said teeth, and
e) tapering means cooperating with at least a region of said teeth for presenting a sequence thereof having predetermined heights which define a substantially progressive taper relative to said second surface when in said predetermined position for progressively engaging a conductor located therebetween.

53. A terminal block, comprising:
a) a base member,
b) a metallic plate supported by said base member,
c) at least one electrical connection means on said plate for connection to electrical circuit or test apparatus,
d) a plurality of conductive teeth on a predetermined first surface of said plate, said teeth defining a first plane,
e) substantially cylindrical cap means defining a second surface on one end thereof which defines a second plane juxtaposable in a predetermined position opposite said first surface wherein said planes are non-parallel,
f) positioning means for removably rotating said cap means into said predetermined position in said base member and supporting said cap therein,
g) metallic concentric ridge insulation displacing means on said second surface for penetrating the insulation on insulated conductors located between said second surface and said teeth to make electrical contact with such conductors as said cap is rotated into said predetermined position,
h) means for incorporating electrical circuit means into said cap,
i) tapering means, including a taper in the effective thickness of said plate, cooperating with at least a region of said teeth for presenting a sequence thereof having predetermined heights which define a substantially progressive taper between said teeth and said second surface when in said predetermined position, for progressively engaging a conductor located therebetween,
j) said teeth being aligned substantially transversely to the strike of said plate from thick to thin, and
k) port means within said base member for admitting at least one wire into said base member for engagement between said second surface and said teeth.

54. A method for terminating a conductor comprising progressively engaging the conductor between a series of teeth and a surface juxtaposable opposite the teeth such that at least a region of the teeth present a sequence which defines a substantially progressive taper toward the surface.

55. The method of claim 54 wherein the series and the surface substantially define non-parallel planes.

56. The method of claim 54 further comprising individually terminating conductors of different sizes between the same teeth and surface.

57. The method of claim 54 wherein:
a) the teeth are a plurality of groups of teeth,
b) the teeth in each particular group have substantially the same dimensions, and
c) the dimensions vary from one group to another.

58. The method of claim 54 further comprising by positioning a boss of a predetermined height between the teeth and the surface, limiting the minimum distance therebetween.

59. The method of claim 54 further comprising:
a) supporting the surface on one end of a substantially cylindrical cap, and
b) incorporating electrical circuit means in the cap.

60. The method of claim 54 further comprising terminating the conductor in a network interface device.

61. The method of claim 54 further comprising terminating the conductor in a terminal block adapter.

62. The method of claim 54 further comprising supporting conductive teeth on a metallic plate incorporating the teeth therein, and wherein the taper results at least in part from a taper in the effective thickness of the plate.

63. The method of claim 62 wherein the teeth are aligned substantially transversely to the strike of the plate from thick to thin.

64. The method of claim 54 further comprising penetrating insulated conductors engaged between the surface and the teeth with conductive insulation displacing means supported on the surface.

65. The method of claim 64 wherein the insulation displacing means is a plurality of concentric ridges.

66. The method of claim 65 wherein said penetrating step further comprises screwing the concentric ridges into a predetermined position to cause the insulation displacing means to penetrate the insulation on such insulated conductors and to make electrical contact therewith.

67. The method of claim 54 wherein said engaging step further comprises admitting the conductor through a port into a terminal block and engaging the conductor in the terminal block.

68. The method of claim 67 further comprising individually terminating conductors of different sizes, and from different sides of the block, between the same teeth and surface.

69. A method for terminating an insulated conductor in a terminal block, comprising:

a) supporting a tapered metallic plate on a base member, the plate having a series of conductive teeth on a predetermined first surface thereof, the plate having electrical connection means for connection to electrical circuit or test apparatus, the teeth defining a first plane, and the teeth being aligned substantially transversely to the strike of the plate from thick to thin, b) on one end of a substantially cylindrical cap, supporting a second surface which defines a second plane juxtaposable in a predetermined position opposite the first surface wherein the planes are non-parallel and at least a region of the teeth present a sequence which defines a substantially progressive taper toward it, c) admitting at least one conductor through a port into the base member for engagement between the second surface and the teeth, d) removably rotating the cap into the predetermined position in the base member and supporting the cap therein, e) as the cap is rotated, progressively engaging the conductor between the teeth and the second surface, and f) as the cap is rotated, and by using metallic concentric ridge insulation displacing means of the second surface, penetrating the insulation on conductors located between the second surface and the teeth to make electrical contact with such conductors as the cap is rotated into the predetermined position.

* * * * *